US012257476B1

(12) United States Patent
Record

(10) Patent No.: US 12,257,476 B1
(45) Date of Patent: Mar. 25, 2025

(54) EXERCISE EQUIPMENT

(71) Applicant: Douglas Wayne Record, Fairbanks, AK (US)

(72) Inventor: Douglas Wayne Record, Fairbanks, AK (US)

( * ) Notice: Subject to any disclaimer, the term of this patent is extended or adjusted under 35 U.S.C. 154(b) by 129 days.

(21) Appl. No.: 18/095,995

(22) Filed: Jan. 11, 2023

Related U.S. Application Data

(60) Provisional application No. 63/298,548, filed on Jan. 11, 2022.

(51) Int. Cl.
*A63B 23/04* (2006.01)
*A63B 21/00* (2006.01)
*A63B 21/012* (2006.01)

(52) U.S. Cl.
CPC ..... *A63B 23/047* (2013.01); *A63B 21/012* (2013.01); *A63B 21/4005* (2015.10); *A63B 21/4035* (2015.10)

(58) Field of Classification Search
CPC . A63B 23/047; A63B 21/012; A63B 21/4005; A63B 21/4035; A63B 69/34; A63B 21/0004; A63B 21/00058–00065; A63B 21/00181; A63B 21/06; A63B 21/0618; A63B 21/065; A63B 21/072; A63B 21/075; A63B 21/4001; A63B 21/4025; A63B 21/4033; A63B 69/002; A63B 2208/0204
See application file for complete search history.

(56) References Cited

U.S. PATENT DOCUMENTS

| | | | | |
|---|---|---|---|---|
| 3,804,410 | A * | 4/1974 | Gilman | A63B 69/34 473/445 |
| 3,889,949 | A * | 6/1975 | Gardner | A63B 69/34 473/445 |
| 4,294,457 | A * | 10/1981 | Thiboutot | A47C 4/42 280/20 |
| 6,761,650 | B1 * | 7/2004 | Dettmann | A63B 69/34 473/445 |
| 9,186,538 | B1 * | 11/2015 | Seen | A63B 21/4007 |
| 2013/0172160 | A1 * | 7/2013 | Poole | A63B 23/0458 482/129 |
| 2014/0073491 | A1 * | 3/2014 | Gilson | A63B 21/06 482/93 |
| 2018/0243597 | A1 * | 8/2018 | Schlegel | A63B 23/047 |
| 2019/0275364 | A1 * | 9/2019 | Saunders | A63B 21/0004 |
| 2019/0388721 | A1 * | 12/2019 | Schlegel | A63B 69/34 |
| 2020/0070029 | A1 * | 3/2020 | Creech | A63B 69/34 |
| 2020/0086167 | A1 * | 3/2020 | Ray | A63B 21/0615 |
| 2023/0173321 | A1 * | 6/2023 | Carr | A63B 21/28 482/97 |

* cited by examiner

*Primary Examiner* — Joshua Lee
*Assistant Examiner* — Catrina A Letterman
(74) *Attorney, Agent, or Firm* — Plager Schack LLP; Mark H. Plager, Esq.; Naomi Mann, Esq.

(57) ABSTRACT

A multi-use exercise apparatus comprises a sled base supporting a push member and lift handles. In certain embodiments, the apparatus may further include vertical weight post, a shoulder bar, and/or a pulling attachment.

9 Claims, 4 Drawing Sheets

EXERCISE EQUIPMENT

RELATED APPLICATION

This application claims benefit to U.S. Provisional Application No. 63/298,548 filed on Jan. 11, 2022, which is incorporated by reference herein in its entirety.

BACKGROUND

The embodiments herein relate generally exercise equipment, and in particular to adjustable exercise equipment for multiple exercise options.

Individuals often desire to exercise different muscles which may require different equipment. However, buying and storing different exercise equipment may be costly and take up too much space. As such, an improved exercise system is desirable.

SUMMARY

In certain embodiments of the invention, disclosed is a multi-use exercise apparatus, comprising: a sled base comprising a first side sled component and a second side sled component, the first side sled component and the second side sled component being aligned parallel to one another and each comprising an elongated main sled body configured to slide on a ground surface; a push member couple to the sled base and configured to enable a user to push the multi-use exercise apparatus; a frame including a first side horizontal bar and a second side horizontal bar which are equally elevated above the sled base and run parallel to the main sled body of the first side sled component and a second side sled component, the frame being supported on the sled base via an elevating support structure coupled between the sled base and the frame, the elevating support structure including: a first side front frame support post extending vertically upwards from a front section of the first side sled component, a second side front frame support post extending vertically upwards from a front section of the second side sled component, wherein the second side front frame support post is in mirroring relationship to the first side front frame support post, a first side rear frame support post extending vertically upwards from a rear section of the first side sled component, a second side rear frame support post extending vertically upwards from a rear section of the second side sled component, wherein the second side rear frame support post is in mirroring relationship to the first side rear frame support post, wherein the first side front frame support post and the first side rear frame support post are coupled between the first side horizontal bar of the frame and the first side sled component, wherein the second side front frame support post and the second side rear frame support post are coupled between the second side horizontal bar of the frame and the second side sled component, and lift handles comprising a first side lift handle coupled to the first side sled component and a second side lift handle coupled to the second side sled component, the lift handles configured to enable a user to lift the multi-use exercise apparatus while walking.

In embodiments, each of first side sled component and a second side sled component includes a vertical weight post coupled thereto, the vertical weight post comprising an elongated body aligned in perpendicular orientation to the elongated main sled body of the respective sled component. In some embodiments, the exercise apparatus may further comprise a shoulder bar coupled to the sled base via a pair of shoulder bar support posts. In certain embodiments, a height position of the shoulder bar is adjustable on the pair of shoulder bar support posts. In some embodiments, the exercise apparatus may further comprise a pulling attachment coupled to the sled base and configured to enable a user to pull the apparatus. In certain embodiments, the exercise apparatus may further comprise a frame supported on the sled base via an elevating support structure coupled between the sled base and the frame. In some embodiments, the frame has a square and/or rectangular geometric configuration. In certain embodiments, the frame includes a first side bar, a second side bar, a front bar coupled between front ends of the first side bar and the second side bar, and a rear bar coupled between the rear ends of the first side bar and the second side bar. In some embodiments, the first side lift handle is supported on the first side bar via an elevated support structure coupled between the first side lift handle and the first side bar, and a second side lift handle supported on the second side bar via an elevated support structure coupled between the second side lift handle and the second side bar, the lift handles being configured to enable a user to lift the multi-use exercise apparatus while situated within the frame and gripping the lift handles. In some embodiments, the push member comprises a pair of push bars configured to couple to a pair of push bar receivers provided on the front bar and/or the rear bar of the frame. In some embodiments, the exercise apparatus may further comprise a pull loop configured to couple to a pulling attachment to enable a user to pull the apparatus.

BRIEF DESCRIPTION OF THE FIGURES

The detailed description of some embodiments of the invention will be made below with reference to the accompanying figures, wherein the figures disclose one or more embodiments of the present invention.

DETAILED DESCRIPTION OF CERTAIN EMBODIMENTS

Figure 1:
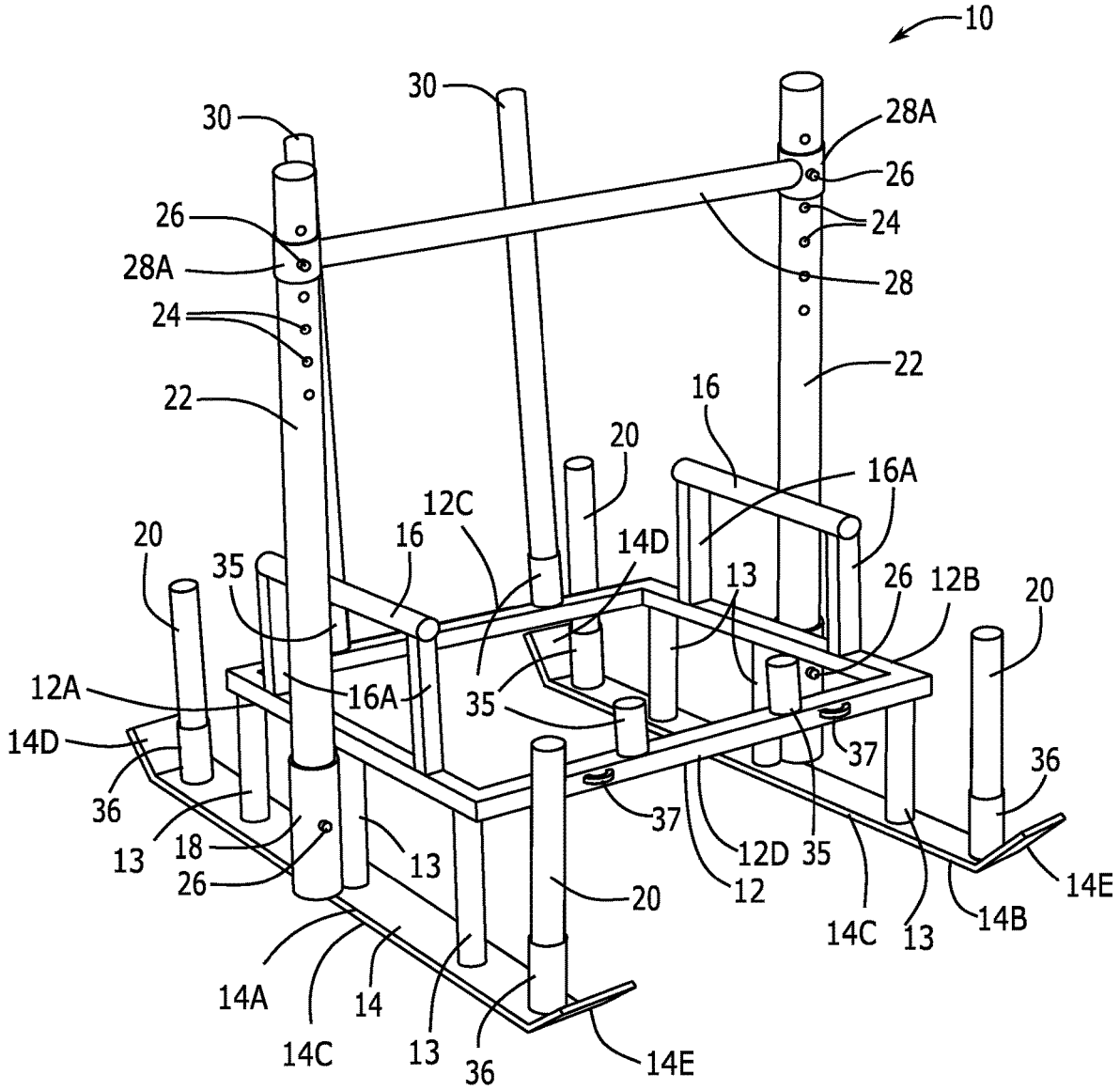
FIG. 1 is a front perspective view of a multi-use exercise apparatus, according to various embodiments.
Figure 2:
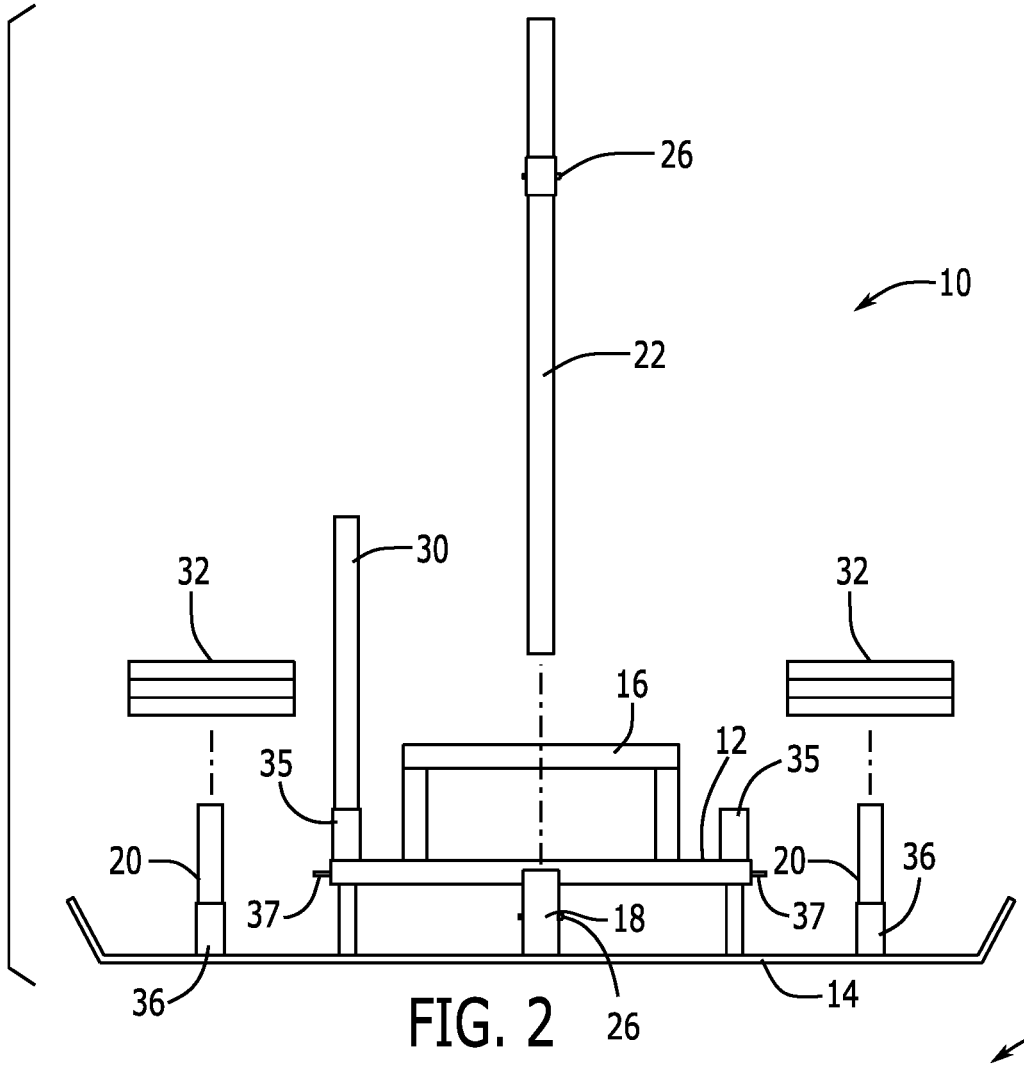
FIG. 2 is a side exploded view of the multi-use exercise apparatus.
Figure 3:
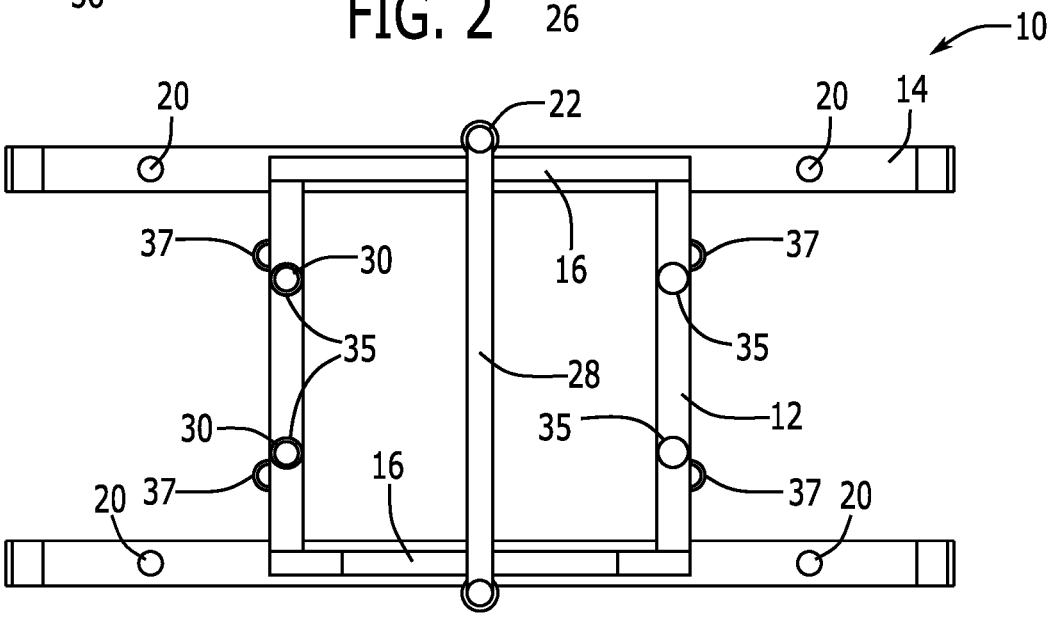
FIG. 3 is a top plan view thereof.

In certain embodiments as depicted in FIGS. 1-6, a multi-use exercise apparatus 10 may comprise a sled base 14 and a frame 12 supported on sled base 14. Sled base 14 and frame 12 may be configured to support multiple components that enable various forms of exercise using apparatus 10. In some embodiments, such components may include, but are not limited to, weights 32, a shoulder bar 28, a push member 30, lift handles 16, and/or pull loops 37 configured to enable various pulling attachments, e.g. pull belt, harness, rope, etc., to be attached to exercise apparatus 10.

In certain embodiments, sled base 14 may comprise a first or left side sled component 14A and a corresponding second or right side sled component 14B. In embodiments, the left and right side sled components may substantially mirror one another and are parallelly aligned on opposite sides of apparatus 10.

In embodiments, the left side and right side sled components 14A, 14B, may each have an elongated main sled body 14C configured to slide on a ground surface and provide a sturdy and slidable support base for exercise apparatus 10. Main sled body 14C may comprise a flat or substantially flat configuration in certain embodiments. It shall be appreciated that while each of sled components 14A and 14B are depicted as having a single main sled body 14C, each component may be formed from multiple sled bodies in alternate embodiments. In some embodiments, each of left side and right side sled components 14A, 14B may further include a front end wall 14D which extends upwards from a front end of main sled body 14C and/or a rear end wall 14E which extend upwards from a rear end of main sled body 14C. In one embodiment, front end walls 14D and rear end walls 14E may be at an angle of approximately 45 degrees with respect to main sled body 14C. It shall be appreciated that different configurations of sled components 14A, 14B, including curved surfaces, transitions, etc., may be employed in alternate embodiments.

In some embodiments, apparatus 10 may comprise frame support posts 13 configured to provide an elevating support structure for frame 12. In certain embodiments, support post 13 may be supported on sled base 14, wherein a bottom end of each of frame support posts 13 is coupled to a top side of the sled base 14, and a top end of each of frame support posts 13 is coupled to a bottom side of frame 12. In one embodiment, frame support posts 13 are provided on mirroring front, middle, and rear locations on each one of left side sled component 14A and right side sled component 14B, as shown. It shall be appreciated however, that various numbers of frame support posts 13 may be provided at different locations on sled base 14 in alternate embodiments. In some embodiments, support posts 13 may be approximately 1 foot to approximately 3 feet high, or approximately 1.5 feet to approximately 2.5 feet high. It shall be appreciated that supports posts may be of different heights and/or height adjustable (e.g., via a telescoping mechanism, etc.) in alternate embodiments. It shall be appreciated that different structures for providing an elevated support for frame 12 may be used in alternate embodiments.

In certain embodiments, frame 12 may comprise a left side bar 12A ("first side horizontal bar"); a right side bar 12B ("second side horizontal bar"); a front bar 12C, coupled between the front ends of left side and right side bars 12A, 12B; and a rear bar 12D, coupled between the rear ends of left side and right side bars 12A, 12B. In some embodiments, frame 12 may be a square and/or rectangular frame, wherein bars 12A-12D are straight, as depicted in the figures. It shall be appreciated that bars 12A-12D may include curvatures in alternate embodiments. In embodiments, left side bar 12A and right side bar 12B may substantially mirror one another and are parallelly aligned on opposite sides of apparatus 10. Likewise, front bar 12C and rear bar 12D may substantially mirror one another and are parallelly aligned on opposite sides of apparatus 10. In some embodiments, left side bar 12A may be directly coupled to support posts 13 that are coupled to left side sled component 14A, and right side bar 12B may be directly coupled to support posts 13 that are coupled to right side sled component 14B.

In certain embodiments, weight post(s) 20 may be provided on sled base 14. Weight post(s) 20 may comprise a vertically oriented elongated body that is configured to retain one or more weights 32, which may be stacked on the post. In some embodiments, exercise apparatus 10 may comprise four weight posts 20, wherein each sled component 14A, 14B may include one weight post 20 proximate its back end and one weight post proximate its front end, where the weight posts are symmetrically disposed about apparatus 10. Weight posts 20 may be configured to hold any number of weights which may be stacked atop one another, up to the height of the post. A central opening 32A within each weight allows the weight to be passed through and retained on weight post 20. In some embodiments, a weight stop 36 may be provided at a bottom end of each weight post 20, and is configured to keep weights 32 flat rather than canted on weight post 20. Weight post(s) 20 allow user 34 to adjust the weight of apparatus 10 for performance of various types of exercises as will be described. It shall be appreciated that apparatus 10 may comprise any number of weight posts 20, which may be provided at different locations on apparatus 10 according to various embodiments. Weight posts(s) 20 may further be configured to support any number of weights, and/or weights of different magnitudes in various embodiments.

In certain embodiments, a pair of handrails or lift handles 16 may be provided on apparatus 10 and are configured to enable user 34 to lift the apparatus while gripping the lift handles. In certain embodiments, lift handles 16 may include a left side lift handle and a right side lift handle, which are symmetrically disposed about apparatus 10 and are supported on left side and right side bars 12A, 12B, respectively. In one embodiment, vertical posts 16A may be coupled between each of left side and right side bars 12A, 12B, and are configured to provide an elevated support for lift handles 16.

Figure 4:
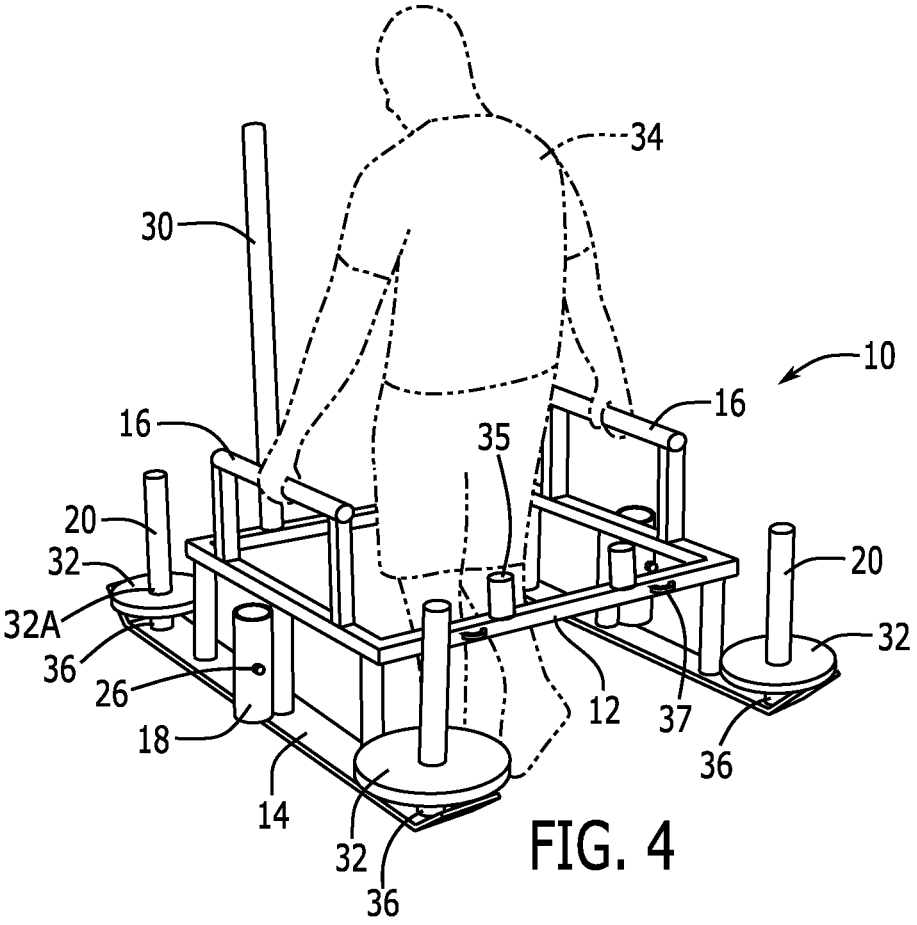
FIG. 4 is a perspective view showing the multi-use gym exercise apparatus in use for performing "farmer carry" exercise.

In one embodiment vertical posts 16A may each be approximately 6 inches to approximately 2 feet high, or approximately 1 foot to approximately 2 feet high. As shown in FIG. 4, lift handles 16 may be used to perform "farmer carry" exercise, wherein user 34 may stand within frame 12 and grip each of the lift handles and lift the apparatus up and down. The user may further walk while carrying exercise apparatus 10. This exercise uses the overall weight of exercise apparatus 10, which may be adjusted via placement of weights 32, for strengthening and conditioning most of the major muscle groups while providing a cardiovascular stimulus. In certain embodiments, lift handles 16 may be positioned at about hip height, wherein each lift handle may be distanced about 2 to about 8 inches from the body. In certain embodiments, the vertical distance of lift handles 16 above sled base 14 (which is roughly the sum of the height of support posts 13 and vertical posts 16A) may be approximately 2.5 feet to approximately 3.5 feet, or approximately 3 feet to approximately 4 feet. In some embodiments, a horizontal distance between the pair of lift handles 16 may be between about 30 inches and about 36 inches. It shall be appreciated that the vertical distance of lift handles 16 above sled base 14, and the horizontal distance between the pair of lift handles 16 may vary in alternate embodiments. Additionally, exercise apparatus 10 may incorporate various telescoping components that render these distances adjustable in alternate embodiments.

Figure 5:
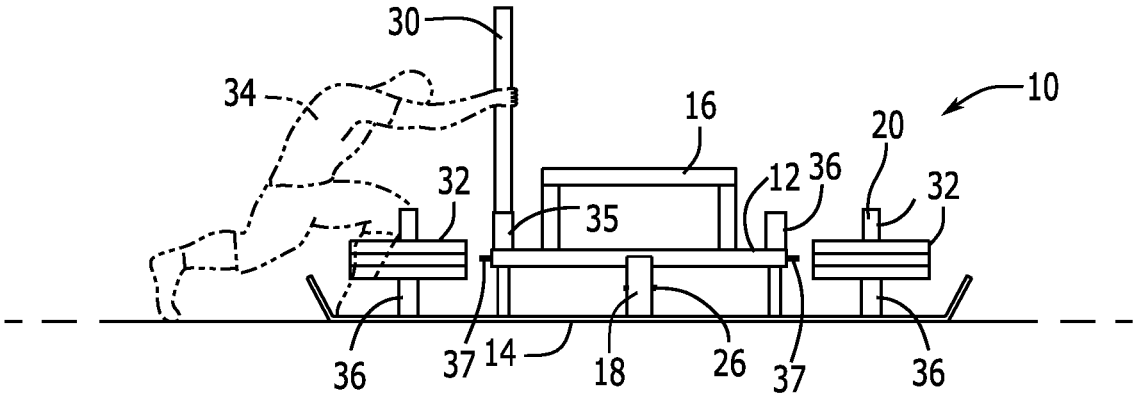
FIG. 5 is another perspective view of the multi-use exercise apparatus in use for performing "push/pull sled" exercise.
Figure 6:
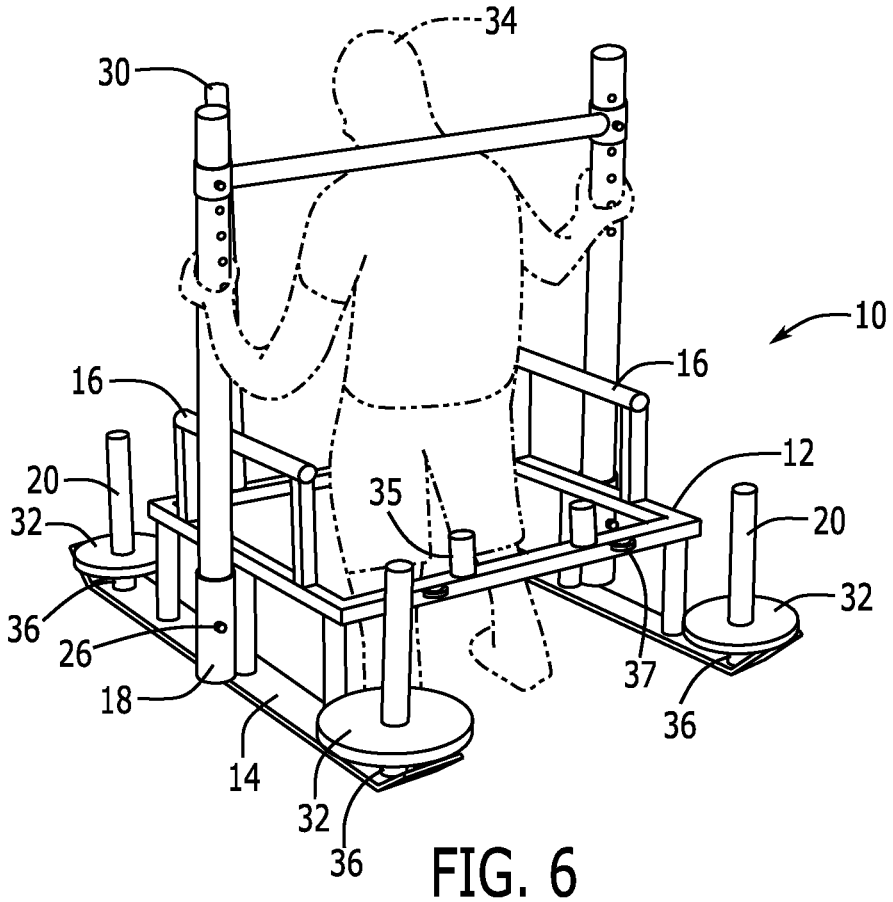
FIG. 6 is another perspective view of the multi-use gym exercise apparatus in use for performing "yoke and deadlift" exercise.

In some embodiments, a sled push member 30 may be coupled to front and/or rear sides of apparatus 10 for enabling user 34 to perform sled push exercise. In certain embodiments, sled push member 30 may comprise a pair of push bars ("push bars 30") between the left and right side sled components, as depicted in FIG. 5. In certain embodiments, a pair of receivers 35 may be provided on each of front bar 12C, and rear bar 12D of frame 12. In further embodiments, each receiver in each pair of receivers 35 may be symmetrically disposed about left and right sides of apparatus 10. Each receiver 35 may comprise a hollow tube configured to retain one of the push bars at its bottom end, wherein the push bar may be slipped inside the receiver. Thus, user 34 may couple the pair of push bars to either the front bar 12C, or the rear bar 12D for performing the sled push exercise, and may remove the push bars if desired. For example, the user may push the apparatus forwards as it slides upon the left and right side sled components, with the push bars attached to the pair of receivers 35 on the front bar 12C. The push bars may then be removed from the front push bar receivers and attached to the back push bar receivers in order to push the sled forwards in the opposite direction of the prior forward push. It shall be appreciated that sled push member 30 or the push bars may be permanently coupled to apparatus 10 in alternate embodiments. Push bar(s) 30 may also be used for performance of sled pull exercise. Additionally, apparatus 10 may comprise pull loops 3 configured to receive various pulling attachments, such as a pull belt, harness, rope, and the like, which may be used for performance of pull exercise. In one embodiment a pair of pull loops 37 which are symmetrically disposed about left and right sides of apparatus 10, may be provided on the front bar 12C and/or the rear bar 12D of frame 12 to enable different direction of travel. It shall be appreciated that various pulling attachments may be permanently attached to exercise apparatus 10 in alternate embodiments.

In certain embodiments, shoulder bar 28 may be supported on sled base 14 via a pair of shoulder bar support posts 22. In one embodiment, the pair of should bar support posts 22 may be symmetrically disposed about left and right sides of apparatus 10, and comprise a left side shoulder bar support post 22 coupled to left side sled component 14A, and a right side should bar support post 22 coupled to right side sled component 14B. In some embodiments, should bar 28 may be coupled to shoulder bar support posts 22 via end sleeves 28A provided at opposite ends of shoulder bar 28. Each end sleeve 28A may include a hole which may align with a hole 24 within support post 22 to which the end sleeve is coupled. A lock pin 26 may be engaged through the holes to attach each end sleeve 28A to its respective support post 22. In some embodiments, should bar support posts 22 may each include a plurality of holes 24 for enabling height adjustment of shoulder bar 28. Shoulder bar 28 may be used for performance of various exercise including "yoke and deadlift" exercise (see FIG. 6), and the like. For example, user 34 may stand within frame 12 and place shoulder bar 28 on the user's shoulders, the user may then lift apparatus 10 up and down, and may further walk while carrying apparatus 10.

It shall be appreciated that the disclosed exercise apparatus 10 can have multiple configurations in different embodiments. In some alternate embodiments, certain components may be added or omitted. In some embodiments, various components of the apparatus may be removable and/or adjustable. In further embodiments, a user may be able to add various components to the apparatus for added workout options.

The disclosed exercise apparatus enables a user or gym owner to avoid having to buy multiple equipment, and further saves the space that would otherwise be needed for the storage of multiple equipment. In one embodiment, the apparatus may be used as a deadlift bar and rack, a push/pull setup, farmers carry, and yoke trainer, among others.

In embodiments, the disclosed apparatus may be made from steel components, which may be bent, welded together, pinned, slip jointed, and/or linked to form the apparatus. It shall be appreciated that the components of exercise apparatus 10 may comprise any alternative known materials in the field and be of any color, size and/or dimensions. It shall be appreciated that the components of exercise apparatus described herein may be manufactured and assembled using any known techniques in the field.

It shall be understood that the orientation or positional relationship indicated by terms such as "upper", "lower", "front", "rear", "left", "right", "top", "bottom", "inside", "outside" is based on the orientation or positional relationship shown in the accompanying drawings, which is only for convenience and simplification of describing the disclosed subject matter, rather than indicating or implying that the indicated device or element must have a specific orientation or are constructed and operated in a specific orientation, and therefore should not be construed as a limitation of the present invention.

As used herein, the articles "a" and "an" are intended to include one or more items, and may be used interchangeably with "one or more." Where only one item is intended, the term "one" or similar language is used. Also, as used herein, the terms "has", "have", "having", "with" or the like are intended to be open-ended terms. Further, the phrase "based on" is intended to mean "based, at least in part, on" unless explicitly stated otherwise.

The constituent elements of the disclosed device and system listed herein are intended to be exemplary only, and it is not intended that this list be used to limit the device of the present application to just these elements. Persons having ordinary skill in the art relevant to the present disclosure may understand there to be equivalent elements that may be substituted within the present disclosure without changing the essential function or operation of the device. Terms such as 'approximate,' 'approximately,' 'about,' etc., as used herein indicate a deviation of within +/−10%. Relationships between the various elements of the disclosed device as described herein are presented as illustrative examples only, and not intended to limit the scope or nature of the relationships between the various elements. Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

It shall be appreciated that the components of the disclosed exercise apparatus described herein may be assembled and disassembled to the user's preferences. The complete disas-sembly allows for further space saving otherwise needed for the storage of multiple equipment or the assembled embodiment of this apparatus.

It shall be appreciated that the components of the disclosed exercise apparatus can be manufactured using hollow bars or solid bars. Hollow bars would allow the apparatus to be manufactured at less expense and would be less shipping weight.

What is claimed is:

1. A multi-use exercise apparatus, comprising:

a sled base comprising a first side sled component and a second side sled component, the first side sled component and the second side sled component being aligned parallel to one another and each comprising an elongated main sled body configured to lay horizontally flat against and slide on a ground surface;

a push member coupled to the sled base and configured to enable a user to push the multi-use exercise apparatus;

a frame including a first side horizontal bar and a second side horizontal bar which are equally elevated above the sled base and run parallel to the main sled body of the first side sled component and the second side sled component, the frame being supported on the sled base via an elevating support structure coupled between the sled base and the frame, the elevating support structure including:

a first side front frame support post extending vertically upwards from a front section of the first side sled component, a second side front frame support post extending vertically upwards from a front section of the second side sled component, wherein the second side front frame support post is in mirroring relationship to the first side front frame support post, a first side rear frame support post extending vertically upwards from a rear section of the first side sled component, a second side rear frame support post extending vertically upwards from a rear section of the second side sled component, wherein the second side rear frame support post is in mirroring relationship to the first side rear frame support post, wherein the first side front frame support post and the first side rear frame support post are coupled between the first side horizontal bar of the frame and the first side sled component, wherein the second side front frame support post and the second side rear frame support post are coupled between the second side horizontal bar of the frame and the second side sled component, and lift handles provided above the frame and comprising a first side lift handle coupled to the first side horizontal bar and above the first side sled component via first side vertical posts, and a second side lift handle coupled to the second side horizontal bar and above the second side sled component via second side vertical posts, the lift handles configured to enable a user to lift the multi-use exercise apparatus while walking, wherein the first side vertical posts extend between the first side lift handle and the first side horizontal bar, and wherein the second side vertical posts extend between the second side lift handle and the second side horizontal bar.

2. The multi-use exercise apparatus of claim 1, wherein each of the first side sled component and the second side sled component includes a vertical weight post coupled thereto, the vertical weight post comprising an elongated body aligned in perpendicular orientation to the elongated main sled body of a respective one of the first side sled component or the second side sled component.

3. The multi-use exercise apparatus of claim 1, further comprising a shoulder bar coupled to the sled base via a pair of shoulder bar support posts.

4. The multi-use exercise apparatus of claim 3, wherein a height position of the shoulder bar is adjustable on the pair of shoulder bar support posts.

5. The multi-use exercise apparatus of claim 1, further comprising a pulling attachment element coupled to the sled base and configured to enable a pulling attachment to be attached to the multi-use exercise apparatus so that a user may pull the multi-use exercise apparatus via the pulling attachment.

6. The multi-use exercise apparatus of claim 1, wherein the frame has a square and/or rectangular geometric configuration, and further comprises a front horizontal bar coupled between front ends of the first side horizontal bar and the second side horizontal bar, and a rear horizontal bar coupled between rear ends of the first side horizontal bar and the second side horizontal bar.

7. The multi-use exercise apparatus of claim 6, the lift handles being configured to enable a user to lift the multi-use exercise apparatus while situated within the frame and gripping the lift handles.

8. The multi-use exercise apparatus of claim 6, said push member comprising a pair of push bars configured to couple to a pair of push bar receivers provided on the front horizontal bar and/or the rear horizontal bar of the frame.

9. The multi-use exercise apparatus of claim 6, further comprising at least one pull loop configured to couple to a pulling attachment to enable a user to pull the multi-use exercise apparatus.

* * * * *